US008061788B2

(12) United States Patent
Bocchini

(10) Patent No.: US 8,061,788 B2
(45) Date of Patent: Nov. 22, 2011

(54) CONVERTIBLE REFRIGERATED DISPLAY CASE

(75) Inventor: Pierluigi Bocchini, Jesi (IT)

(73) Assignee: Clabo Group S.p.A., Jesi (An) (IT)

( * ) Notice: Subject to any disclaimer, the term of this patent is extended or adjusted under 35 U.S.C. 154(b) by 225 days.

(21) Appl. No.: 12/448,830

(22) PCT Filed: Dec. 20, 2007

(86) PCT No.: PCT/IT2007/000896

§ 371 (c)(1),
(2), (4) Date: Jul. 9, 2009

(87) PCT Pub. No.: WO2008/087678

PCT Pub. Date: Jul. 24, 2008

(65) Prior Publication Data

US 2010/0043471 A1 Feb. 25, 2010

(30) Foreign Application Priority Data

Jan. 19, 2007 (IT) ..... MC20070005 U

(51) Int. Cl.
*A47F 3/04* (2006.01)

(52) U.S. Cl. ..... 312/116; 312/319.5; 108/108; 108/147.11

(58) Field of Classification Search ..... 312/116, 312/126, 128, 132, 408, 306, 319.5, 319.7; 108/106, 108, 144.11, 147, 147.11–147.13, 108/147.15, 20; 211/90.01–90.04, 103, 126.2, 211/126.4, 126.5, 126.15, 134, 187, 153, 211/175, 207, 190, 208; 248/223.41, 243, 248/244, 295.11; 187/249, 342
See application file for complete search history.

(56) References Cited

U.S. PATENT DOCUMENTS

| | | | | |
|---|---|---|---|---|
| 3,982,801 | A * | 9/1976 | Heidorn et al. | 312/306 |
| 5,058,507 | A * | 10/1991 | Muth | 105/105 |
| 6,286,441 | B1 * | 9/2001 | Burdi et al. | 108/147 |
| 6,412,296 | B1 * | 7/2002 | Rossi | 62/255 |
| 6,516,478 | B2 * | 2/2003 | Cook et al. | 5/611 |
| 6,546,880 | B2 * | 4/2003 | Agee | 108/147 |

* cited by examiner

*Primary Examiner* — Janet M Wilkens
*Assistant Examiner* — Andrew Roersma
(74) *Attorney, Agent, or Firm* — Hodes, Pessin & Katz, P.A.

(57) ABSTRACT

A refrigerated display case having a bearing base and a top glass compartment designed to be alternatively used to display home made ice cream and pastry, the display case has a horizontal wall above the base designed to house the containers of homemade ice cream and having a pair of shelves designed to support pastry trays inside the front wall of the glass compartment the shelves being able to slide together towards the top of the glass compartment in order to be concealed from the sight of customers situated in front of the display case.

10 Claims, 3 Drawing Sheets

CONVERTIBLE REFRIGERATED DISPLAY CASE

Figure 1:
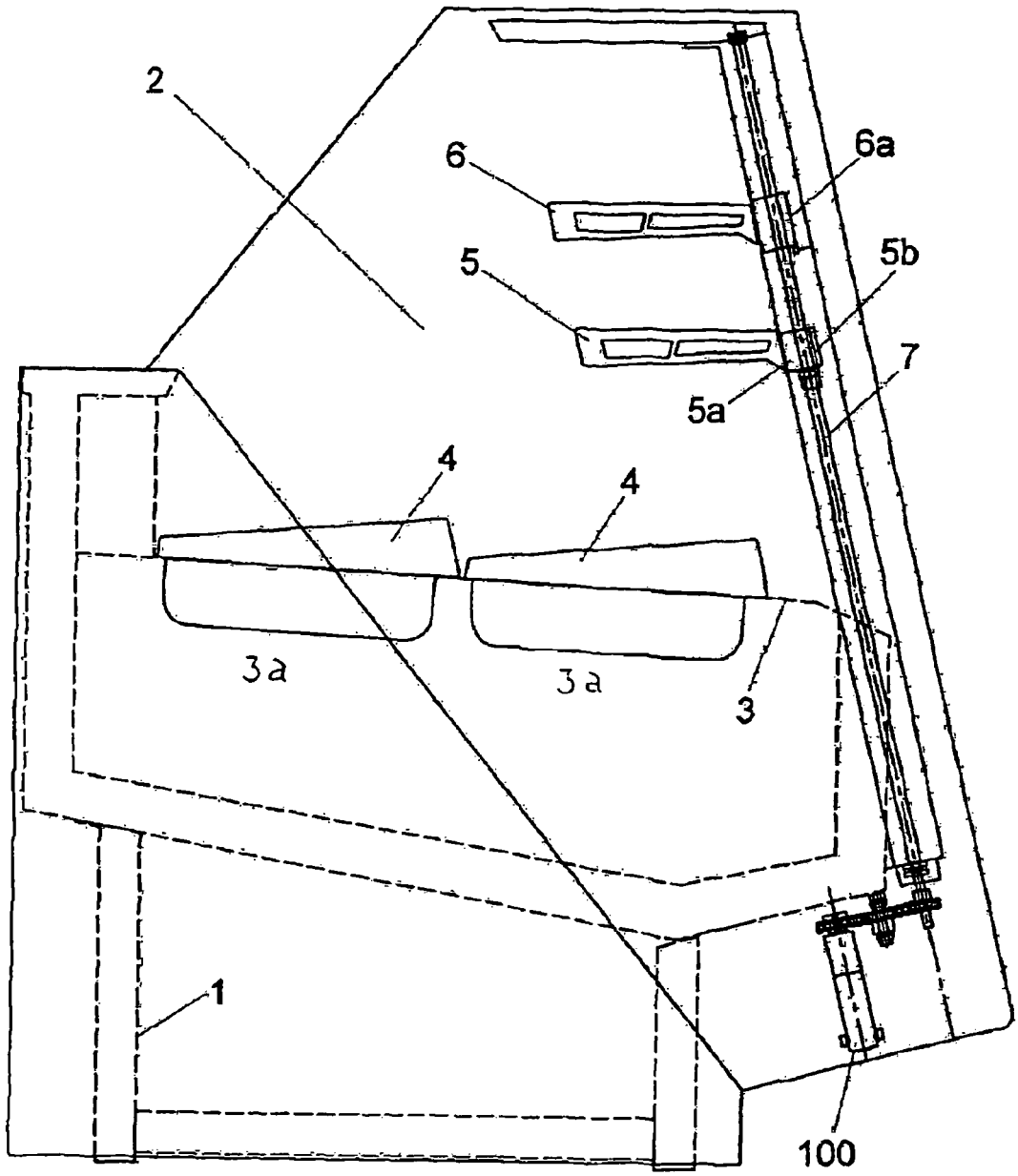

The present patent application refers to a convertible refrigerated display case.

Refrigerated display cases are normally used for low-temperature storage, display and distribution to customers of products.

The said refrigerated display cases are characterised by a basically standard configuration, comprising a large bearing base made of wood or sheet metal that contains the refrigerator unit and relevant pipes, which supports a large glass display case that allows customers to see the displayed products.

Similar display cases are used both to store-display containers of homemade ice cream, cakes and pastry items.

According to the specific use, current refrigerated display cases have a different configuration inside the top glass compartment.

The display cases used to sell ice cream are provided with a basically horizontal wall on the bottom of the glass compartment (that is to say on top of the base), which is provided with a series of openings designed to receive the containers of homemade ice cream.

On the contrary, the display cases used to sell pastry are provided with a series of longitudinal shelves that are suitably supported immediately behind the front wall of the glass compartment.

Although these two different types of display cases are extremely satisfactory from the functional viewpoint, they are impaired by a significant drawback that basically consists in total lack of versatility.

Reference is made to the fact that, in view of their "rigid" internal organisation, traditional refrigerated display cases do not offer any versatility of use, meaning that a display case designed to display and sell ice cream cannot be used to display and sell pastry.

This is a serious drawback in view of the fact that the both pastry and ice cream are normally sold in the same place (for example bars or bakeries).

For instance, the same shop may sell more ice cream during the summer season and more pastry during the rest of the year.

In view of the above, it would be extremely advantageous for the owner of the shop to adapt the refrigerated display case from time to time to the specific sale needs.

Based on these considerations and in view of the fact that no multi-purpose refrigerated display cases are currently available on the market, the purpose of the present invention is to provide a convertible refrigerated display case able to adapt its internal structure according to the specific products to be displayed.

In other words, the display case of the invention can be easily converted from a display case used to display homemade ice cream to a display case used to display cakes.

The said purpose has been achieved by providing the glass compartment of the display case both with the horizontal wall with openings for homemade ice cream containers and one or more front shelves for pastry.

It must be noted that the front shelves have been devised as mobile shelves, meaning that they can be removed when the display case is used to sell ice cream.

More precisely, the said shelves are subjected to the action of suitable actuators that allow them to slide upwards in parallel direction, in such a way that they can reach the top of the glass compartment and be stored one against the other in compact arrangement.

The upward movement and the compact arrangement of the front shelves are provided in order to allow customers to see the goods displayed in the glass compartment of the display case of the invention when the display case is used to sell ice cream.

In particular, the possibility to move the shelves in the aforementioned non-operative position is the main feature of the display case of the invention.

Without such a possibility, the voluminous presence of the shelves in the front of the glass compartment would be incompatible with ice cream sale, not only for aesthetical reasons, but also because it would prevent customers from seeing the contents of the containers positioned on the bottom of the glass compartment.

When the display case of the invention is used to sell pastry, the front shelves can be easily repositioned in their operative configuration, that is to say in a clearly visible position on the back of the front wall of the glass compartment.

In such a case, the openings provided on the bottom of the glass compartment (which are normally used to support ice cream containers) are easily covered with suitable covers provided with the display case of the invention.

Of course, the purpose of the covers is to provide a perfectly continuous surface on the bottom wall, which can be suitably used as support for a number of trays full of pastry, cakes and similar items.

Figure 2:
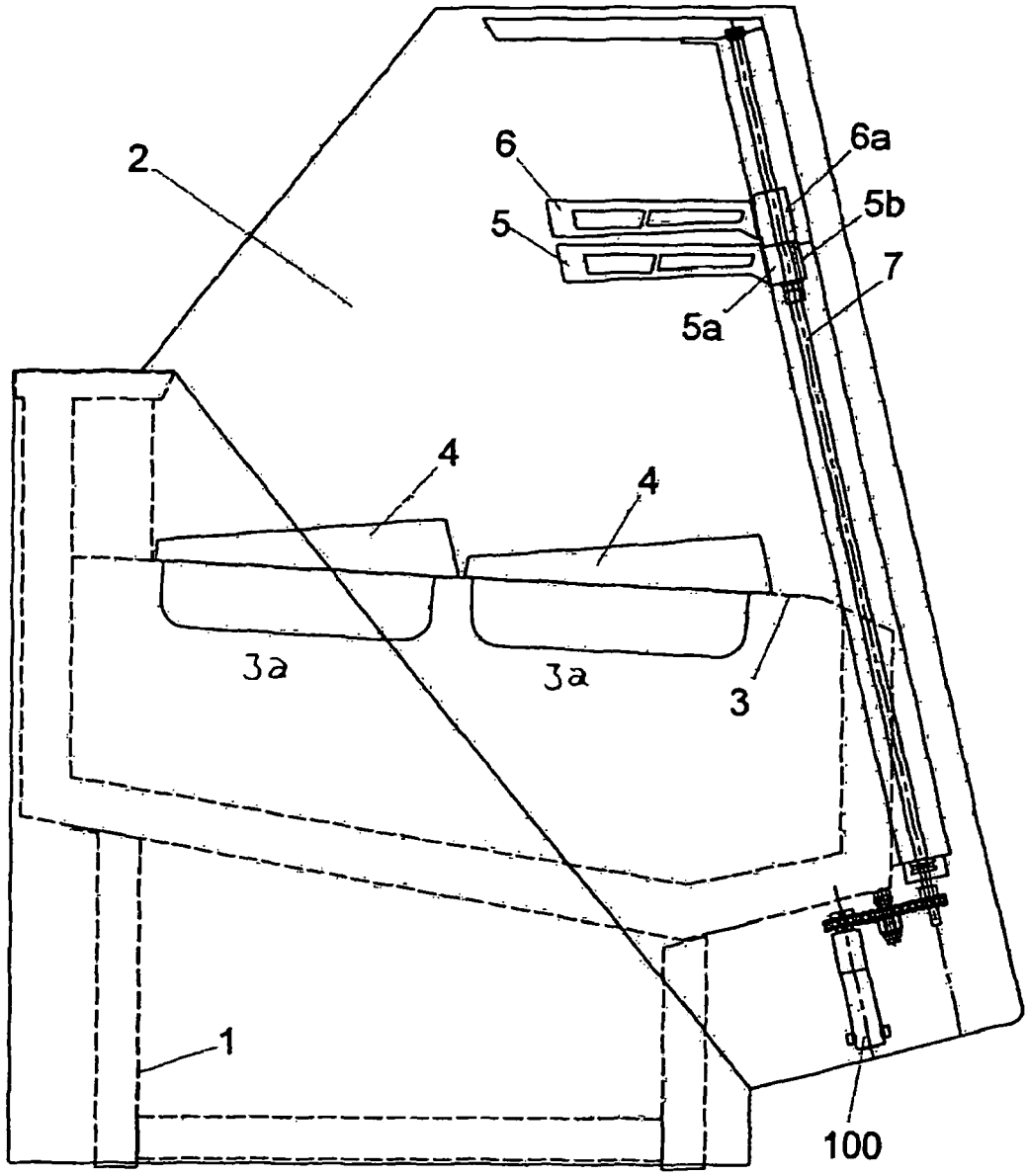
Figure 3:
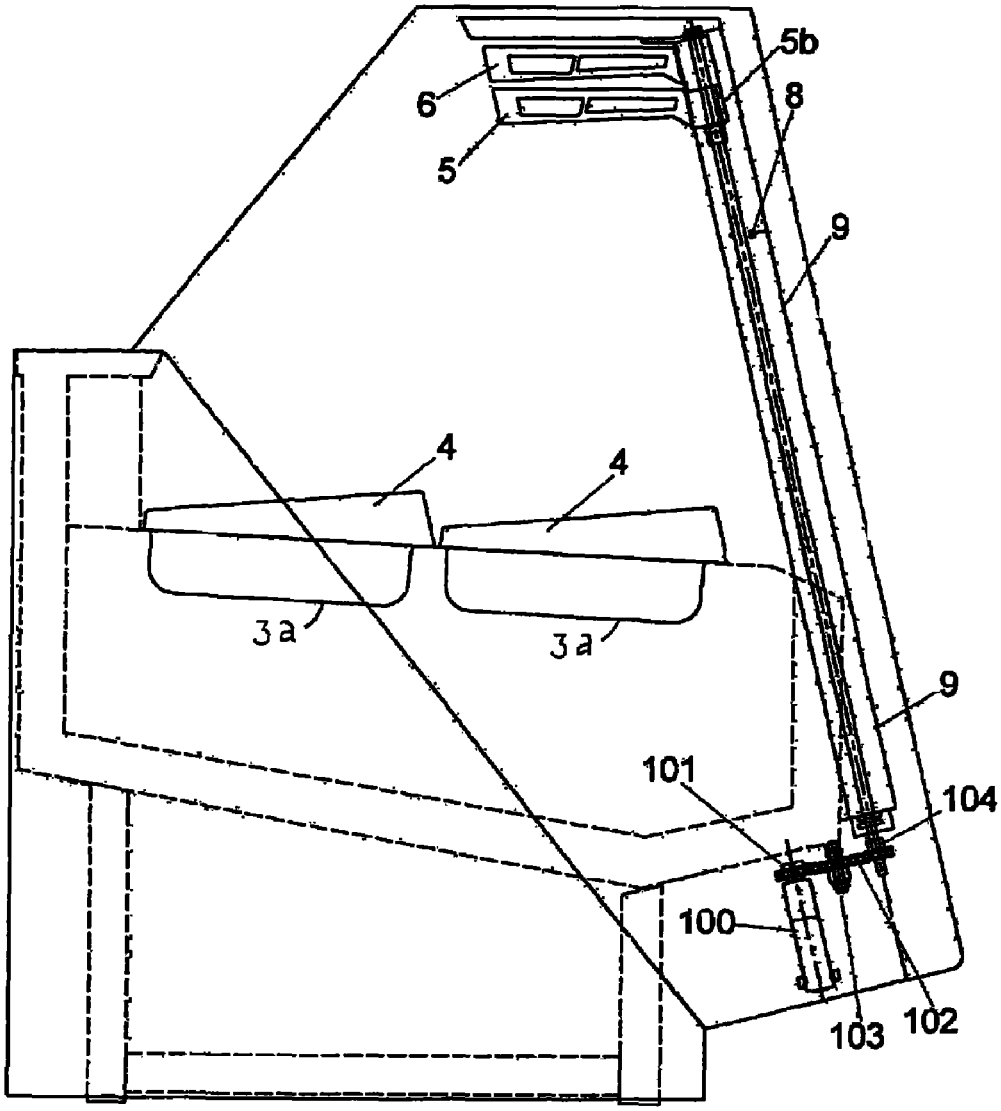

For purposes of clarity, the description of the invention continues with reference to the enclosed drawings, which only have an illustrative, not limiting purpose, whereby FIGS. 1, 2 and 3 are cross-sectional side views of the display case of the invention sectioned in one of the front uprights to show the means designed to actuate the two sliding shelves.

In particular, FIG. 1 shows the two sliding shelves in operative position, FIG. 2 shows the same shelves in an intermediate phase of the sliding movement and FIG. 3 show the same shelves in "compact" non-operative position.

With reference to the aforementioned figures, the convertible display case of the invention normally comprised a bearing base (1) designed to contain the refrigerator unit and corresponding pipes, and a top glass compartment (2), with the interposition of a basically horizontal wall (3) provided with large openings (3*a*) designed to receive corresponding containers (4) used to sell homemade ice cream.

The main peculiarity of the display case of the invention consists in the fact that it is provided with a pair of sliding shelves (5, 6) that project inside the front wall of the glass compartment (2).

As mentioned earlier, the said shelves (5, 6) are designed to make alternate travels from down upwards and vice versa, in such a way that they pass from the operative position shown in FIG. 1 to the non-operative position shown in FIG. 3.

In the operative position the shelves (5, 6) are maintained suitably spaced and occupy a large longitudinal section of the front wall of the glass compartment (2).

In the non-operative position the shelves (5, 6) reach the top of the glass compartment (2) in such a way that the lower shelf (5) touches the upper shelf (6).

It is now necessary to describe the means used to provide such a sliding capacity to the said shelves (5, 6).

The two longitudinal ends of the display case of the invention are provided with two threaded bars (7) with basically vertical direction.

More precisely, the lower end of each bar (7) is engaged inside the base (1) of the display case, where it is subjected to the action of a gear motor (100) designed to drive it into inverse rotations, while the upper end of the same is arranged on top of the glass compartment (2).

The lower projecting shelf (5) is fixed at the longitudinal ends on two nuts (5*a*), each of them being engaged in one of the threaded bars (7).

On the other hand, the upper projecting shelf (6) is fixed at the longitudinal ends to two couplings with vertical axis (6*a*), each of them being simply inserted on the outside of one of the threaded bars (7), free to slide upwards and downwards with respect to the same.

In view of the above description, it appears evident that the rotation in either direction of the two threaded bars (7) determines the ascending or descending travel of the lower shelf (5) due to the helicoidal coupling between the bars (7) and the nuts (5*a*) that support it.

Moreover, it must be noted that the descending and ascending travels of the upper shelf (6) are not directly determined by the actuation of the bars (7), but by corresponding sliding movements of the lower shelf (5) in downward and upward direction.

By assuming that the two shelves (5, 6) are initially in the non-operative compact position, as shown in FIG. 3, it must be noted that the descending travel may be generated by actuating the two threaded bars (7) in the suitable rotational direction.

As a matter of fact, the rotation imposed on the bars (7) determines the gradual downward sliding of the two nuts (5*a*) engaged in the bars (7); in addition to a corresponding sliding of the lower shelf (5) fitted to the said nuts (5*a*), this also involves a similar sliding by gravity of the upper shelf (6), whose couplings (6*a*) simply rest on the nuts (5*a*) of the lower shelf (5).

During the descending travel the compact position of the two shelves (5, 6) is only maintained for a first short section, because each shelf (5, 6) must be positioned at the corresponding operative height, that is to say at a suitable mutual distance.

The first of the shelves to interrupt the descending travel is the upper shelf (6); this effect is determined when the lower ends of the two couplings (6*a*) reach the two corresponding fixed projections (8) provided on the bearing structure (9) of the two threaded bars (7) at a very short distance from the same, as specifically shown in FIG. 3.

Nevertheless, this does not prevent the lower shelf (5) from continuing the descending travel, together with the rotation of the threaded bards (7) until a predefined stop, when the electronic unit that controls the entire apparatus stops the electrical motor (100) that ensures the rotation of the threaded bars (7).

To that regard, it must be noted that the two nuts (5*a*) associated with the lower shelf (5) have been designed in such a way that they are not subjected to the interference of the two projections (8) used to ensure the lower stop for the couplings (6*a*) of the upper shelf (6).

As a matter of fact, the external wall of the nuts (5*a*) is provided with a longitudinal groove (5*b*) that allows them to exactly release the fixed projections (8) without being hindered by them during the descending and ascending travels.

To replace the two shelves (5, 6) in their non-operative "compact" position, it will be simply necessary to restart the rotation of the threaded bars (7) in the opposite direction.

In this way, the lower shelf (5) will start sliding upwards until it interferes with the lower side of the upper shelf (6); further to the said interference, the lower shelf (5) will determine the movement of the upper shelf (6) towards the top of the glass compartment (2).

Also in this case, the lower shelf (5) and the upper shelf (6) that rests on it will stop when the management and control electronic unit deactivates the rotation of the two threaded bars (7).

The enclosed figures show a preferred embodiment of the mechanisms designed to determine the aforementioned rotation of each threaded bar (7).

A gear motor (100) designed to invert the rotational direction is mounted inside the bottom of the base (1) in basically vertical position.

A pinion (101) is splined on the shaft, in upward position, of the gear motor (100), engaged to a drive chain (102) that is also engaged by means of a chain tensioner (103) with a toothwheel (104) splined at the lower end of the threaded bar (7). It is noted that the chain (104) extends longitudinally towards the display case in order to engage with the toothwheels (102) of the two bars (7).

As shown in the aforementioned figures, the electrical motor (100) is mounted inside the base (1) with the same inclination angle as the threaded bar (7).

According to the preferred embodiment shown in the aforementioned figures, one of the lateral uprights of the glass compartment (2) acts as frame to support and conceal each threaded bar (7).

For the same purpose, however, the same threaded bars (7) can be associated with a dedicated independent structure suitably positioned on the two sides of the glass compartment.

Finally, it must be noted that, without leaving the scope of the inventive idea, the aforementioned alternate movement of the two shelves (5, 6) may be obtained with different solutions—that is to say actuators of different type—other than the two threaded bars, such as for example jacks or drive chains.

The invention claimed is:

1. Convertible refrigerated display case comprising a bearing base (1) and a glass compartment (2), with the interposition of a basically horizontal wall (3) that supports ice cream containers (4), characterised by the fact that the display case is provided with, a lower shelf (5) and an upper shelf (6) positioned internally on a front wall of the glass compartment (2) the shelves being assisted by actuators (7) positioned vertically within the display case, the respective shelves being slidably mounted on the actuators wherein the shelves may be movable from an upper rest position, through intermediate operative positions to a lower rest position, wherein when the shelves are in the upper rest position, the shelves touch one another in a compact arrangement and the shelves do not interfere with viewing goods within the display case wherein in the lower rest position, the shelves are arranged at different height in a basically central area of the glass compartment (2).

2. Convertible refrigerated display case as claimed in claim 1, characterised by the fact that the actuators designed to move the shelves (5, 6) consist of two threaded bars (7) positioned in basically vertical direction, in such a way that a lower end of each bar is engaged inside the base (1) connected to a gear motor (100) designed to impose inverse rotations and an upper end of each bar is arranged at a top of the glass compartment (2); the lower shelf (5) is coupled with the said pair of threaded bars (7) by means of a pair of nuts (5*a*) and the upper shelf (6) is coupled with the threaded bars by means of a pair of freely sliding couplings (6*a*); wherein the inverse rotations of the two threaded bars (7) determine the upward and downward sliding of the said nuts (5*a*) of the lower shelf (5) upward and downward movement of the upper shelf being determined by corresponding movement of the lower shelf.

3. Convertible refrigerated display case as claimed in claim 2, characterised by the fact that downward movement of the upper shelf is determined by a pair of fixed projections (8) in very close position to the two threaded bars (7), in such a way that the fixed projections interfere with the lower ends of the couplings (6*a*) of the upper shelf (6) and are released without interference inside two corresponding longitudinal grooves (5*b*) provided in external position on the two nuts (5*a*) and the lower shelf (5).

4. Convertible refrigerated display case as claimed in claim 2, characterised by the fact that each gear motor (100) designed to actuate a corresponding threaded bar (7) is internally mounted in the base (1) with longitudinal axis perfectly parallel to the longitudinal axis of the bar; it being provided that the electrical gear motor (100) actuates a pinion (101) splined in the shaft engaged with a drive chain (102) that is engaged by means of a chain tensioner (103) with two toothwheels (104) respectively splined at the lower end of the threaded bars (7).

5. Convertible refrigerated display case as claimed in claim 1, characterised by the fact that the actuators (7) designed to move the two sliding shelves (5, 6) consists of a pair of rotary chains with closed circuit along basically vertical trajectory that are actuated by means of corresponding electrical motors housed inside the bearing base (1).

6. Convertible refrigerated display case as claimed in claim 1, characterised by the fact that the actuators (7) designed to move the two sliding shelves (5, 6) consists of a pair of jacks.

7. Convertible refrigerated display case as claimed in claim 1, characterised by the fact that it is provided with a series of covers used to cover openings (3*a*) obtained in the horizontal wall (3) between the bearing base (1) and the glass compartment (2).

8. Convertible refrigerated display case as claimed in claim 1, characterised by the fact that the actuators (7) designed to move the two shelves (5, 6) are housed and supported inside uprights (9) for free sliding of the shelves (5, 6).

9. Convertible refrigerated display case as claimed in claim 8, characterised by the fact that the uprights (9) of each threaded bar (7) consists of the corresponding lateral upright of the glass compartment (2).

10. Convertible refrigerated display case as claimed in claim 8, characterised by the fact that the uprights (9) of each threaded bar (7) consists of a dedicated upright situated at an end of the glass compartment (2).

* * * * *